US010554005B2

(12) United States Patent
Dusailly

(10) Patent No.: US 10,554,005 B2
(45) Date of Patent: Feb. 4, 2020

(54) DEVICE AND METHOD FOR CONNECTING A CABLE AND A CONNECTOR ENSURING THE CONTINUITY OF THE ELECTROMAGNETIC SHIELDING

(75) Inventor: Francois Dusailly, Saint Remy les Chevreuse (FR)

(73) Assignee: GETELEC, Buc (FR)

( * ) Notice: Subject to any disclaimer, the term of this patent is extended or adjusted under 35 U.S.C. 154(b) by 210 days.

(21) Appl. No.: 13/985,097

(22) PCT Filed: Feb. 14, 2012

(86) PCT No.: PCT/FR2012/050318

§ 371 (c)(1),
(2), (4) Date: Sep. 11, 2013

(87) PCT Pub. No.: WO2012/110738

PCT Pub. Date: Aug. 23, 2012

(65) Prior Publication Data

US 2013/0340248 A1 Dec. 26, 2013

(30) Foreign Application Priority Data

Feb. 16, 2011 (FR) ..... 11 51253
Feb. 10, 2012 (FR) ..... 12 51261

(51) Int. Cl.
*H01R 43/00* (2006.01)
*H01R 43/04* (2006.01)

(52) U.S. Cl.
CPC ..... *H01R 43/04* (2013.01); *Y10T 29/53235* (2015.01)

(58) Field of Classification Search
CPC ..... H05K 9/008; H01R 43/04; H01R 9/032; H01R 9/05; H01R 13/6581; Y10T 29/53235; Y10T 29/49208; Y10T 29/49123
USPC ..... 29/874, 875, 876, 883, 828, 748; 439/607.34, 607.58, 578, 607.01–607.59
See application file for complete search history.

(56) References Cited

U.S. PATENT DOCUMENTS 4,156,554 A * 5/1979 Aujla ..... H01R 9/05 174/89
4,307,926 A * 12/1981 Smith ..... H01R 4/562 439/580
4,733,464 A * 3/1988 Gregorac ..... H01R 9/05 29/828

(Continued)

FOREIGN PATENT DOCUMENTS

EP 1 278 211 A1 1/2003

OTHER PUBLICATIONS

International Search Report, dated Jun. 11, 2012, from corresponding PCT application.

*Primary Examiner* — Peter Dungba Vo
*Assistant Examiner* — Kaying Kue
(74) *Attorney, Agent, or Firm* — Young & Thompson

(57) ABSTRACT

A device for joining the end (3*a*) of a shielded coaxial cable (3) and a metal connector (10), the cable including a peripheral metal braid (4) and an axial conductor (2), and including a conductive overmoulding (5) that at least partially surrounds the end of the shielded cable (3) and one end of the connector (10), the overmoulding making contact with the metal braid (4) and the connector (10), so as to ensure the continuity of the electromagnetic shielding of the connection. A method for producing such a connection is also described.

14 Claims, 1 Drawing Sheet

(56) References Cited

Figure 1A:
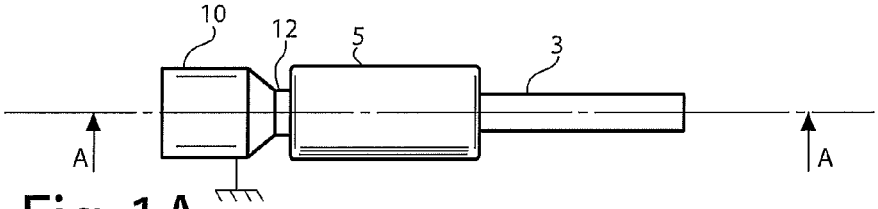

U.S. PATENT DOCUMENTS 5,002,503 A * 3/1991 Campbell ..... H01R 9/053 439/578
5,021,010 A * 6/1991 Wright ..... H01R 24/40 439/578
5,683,263 A * 11/1997 Hsu ..... H01R 13/6477 439/311
6,767,248 B1 * 7/2004 Hung ..... H01R 13/5205 439/578
7,063,551 B1 6/2006 Lin
7,097,499 B1 * 8/2006 Purdy ..... H01R 9/0521 439/578
7,260,891 B2 * 8/2007 Padula ..... H01R 13/504 29/857
7,455,549 B2 * 11/2008 Rodrigues ..... H01R 9/0524 439/578
7,479,033 B1 * 1/2009 Sykes ..... H01R 9/0518 439/578
7,494,355 B2 * 2/2009 Hughes ..... H01R 4/70 439/181
7,513,795 B1 4/2009 Shaw
7,544,094 B1 * 6/2009 Paglia ..... H01R 9/0518 439/585
7,618,276 B2 * 11/2009 Paglia ..... H01R 3/24 439/322
7,674,132 B1 * 3/2010 Chen ..... H01R 9/0524 439/578
7,824,216 B2 * 11/2010 Purdy ..... H01R 4/40 439/578
8,016,605 B2 * 9/2011 Montena ..... H01R 13/622 439/322
8,029,316 B2 * 10/2011 Snyder ..... H01R 13/622 439/578
8,157,589 B2 * 4/2012 Krenceski ..... H01R 9/0524 439/578
8,167,635 B1 * 5/2012 Mathews ..... H01R 24/40 439/277
8,342,879 B2 * 1/2013 Amidon ..... H01R 9/0518 439/320
8,366,481 B2 * 2/2013 Ehret ..... H01R 9/05 439/578
8,568,167 B2 * 10/2013 Montena ..... H01R 9/0524 439/578
8,801,448 B2 * 8/2014 Purdy ..... H01R 9/0524 439/322
9,017,101 B2 * 4/2015 Ehret ..... H01R 9/05 29/874
9,343,855 B2 * 5/2016 Wei ..... H01R 4/40
9,577,391 B2 * 2/2017 Wilson ..... H01R 9/0524
2003/0068924 A1 4/2003 Montena
2004/0069973 A1 4/2004 Keohan et al.
2004/0235351 A1 * 11/2004 Aisenbrey ..... H01R 13/6599 439/607.01
2006/0110977 A1 * 5/2006 Matthews ..... H01R 9/0524 439/578
2007/0049113 A1 * 3/2007 Rodrigues ..... H01R 9/0524 439/578
2011/0014492 A1 * 1/2011 Joshi ..... C23C 18/1641 428/626
2011/0230091 A1 * 9/2011 Krenceski ..... H01R 9/0524 439/578
2012/0080209 A1 * 4/2012 McLinn ..... H01B 11/1008 174/34
2012/0225581 A1 * 9/2012 Amidon ..... H01R 9/0524 439/584
2012/0252263 A1 * 10/2012 Ehret ..... H01R 9/05 439/578
2013/0029513 A1 * 1/2013 Montena ..... H01R 9/0524 439/345

* cited by examiner

DEVICE AND METHOD FOR CONNECTING A CABLE AND A CONNECTOR ENSURING THE CONTINUITY OF THE ELECTROMAGNETIC SHIELDING

The present invention relates to a method and device making it possible to connect a shielded coaxial cable and a metal connector, while ensuring the continuity of the electromagnetic shielding of the assembly.

It is known that coaxial electrical cables are generally electromagnetically protected by a shield produced using a metal braid that surrounds an axial conductor. It is, however, difficult to ensure the continuity of the shielding between said cables and the shielded enclosures of the systems to which they are connected by means of a connector, in particular at the junction between the cable and the connector at the end of the cable. It is known to shield this junction using metal enclosures in contact with the shield and the connector, but this type of shielding has many drawbacks:

the shielding is generally not completely sealed against waves, the shielding obtained is not lasting over time, for example due to a separation of the metal enclosure and the braid and/or a lack of contact due to oxidation, the shielding is not watertight.

The invention therefore more particularly aims to resolve this problem by proposing a method and a device that are simple and inexpensive, in particular making it possible to ensure the continuity of the electromagnetic shielding at the junction between the end of a shielded coaxial cable and a connector to which the cable is connected.

To that end, the invention proposes a device for producing the junction between the end of a shielded coaxial cable and a metal connector, said cable including a peripheral metal braid and an axial conductor, said device being able to comprise a conducting overmolding at least partially surrounding the end of the shielded cable and one end of said connector, said overmolding being in contact with said metal braid and said connector, so as to ensure the continuity of the electromagnetic shielding of the junction.

Overmolding a junction between the end of a cable and a metal connector using a conducting material makes it possible to obtain 360° grounding, ensuring very effective electromagnetic shielding of that junction against high and low frequency electromagnetic disruptions.

Advantageously, the conducting overmolding may include an intrinsically conductive polymer material.

Alternatively, it may include a nonconductive polymer material charged with conducting particles.

One thus benefits both from the encasing and adhesive properties of the material and its conductive properties, thereby resulting in omnidirectional shielding of the junction between the cable and the connector.

Advantageously, the conductive particles may comprise an intrinsically inoxidizable or relatively inoxidizable metal, and/or a metal coated with a conducting layer protecting against oxidation.

It is preferable in this junction for the metal braid to be in direct contact with at least part of the metal contactor. To that end, the end of the shielded coaxial cable is engaged in an end channel of said conductor, and the end of the metal braid and said channel are in contact in one of the following relative positions:

the end of the metal braid of the cable may abut axially against the end walls of the channel, or the end of the metal braid may at least partially cover the walls of said channel, or the walls of said channel may at least partially cover the end of the metal braid.

The shielding braid of the cable may abut against the end walls of said channel of the connector in which the end of the cable engages. According to one alternative embodiment, the end of the shielding braid may cover said walls. According to another alternative embodiment of the invention, the end of the shielding braid is inserted with the end of the cable into said channel of the connector.

Such a connection between a coaxial cable and a connector has several advantages:

it does not include metal parts that may separate and/or be subject to oxidation, and is therefore more reliable and more durable, it cannot be disassembled, which prohibits "repairing" the connection, with the consequences related thereto in terms of reliability, it is sealed against waves, it is watertight, which allows underwater applications.

The invention also relates to a method for connecting a coaxial cable and a metal connector while ensuring the continuity of the electromagnetic shielding of the assembly, which may comprise the following steps:

- stripping one end of the coaxial cable so as to expose the metal shielding braid,
- partially engaging said end of the cable in an end channel of the connector so as to leave a portion of the metal braid visible and put the metal braid and the walls of the channel in contact,
- using a conducting material to overmold the visible part of the braid of said end of the cable and at least part of said channel of the connector so that the contact area between the end of the cable and the connector is covered with said material.

Figure 1B:
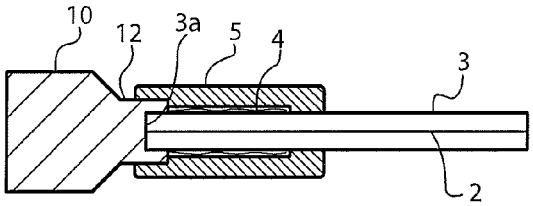
Figure 1C:
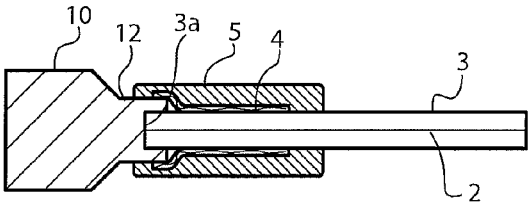
Figure 1D:
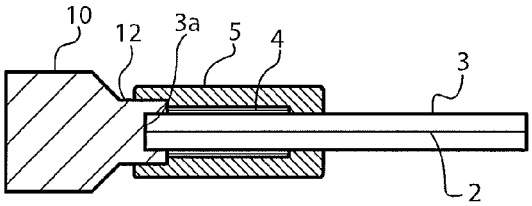

Embodiments of the invention will be described below, as non-limiting examples, in reference to the appended drawings, in which:

FIG. 1A is an elevation view of a junction between a cable and a connector with overmolding, FIG. 1B is a diagrammatic axial cross-sectional view A-A of the junction between a cable and a connector with overmolding, FIG. 1C is an axial cross-sectional view A-A of a first alternative of a junction between a cable and a connector with overmolding, FIG. 1D is an axial cross-sectional view A-A of a second alternative junction between a cable and a connector with overmolding.

In this example, as shown in particular in FIGS. 1A to 1D, the device according to the invention comprises:

- the end 3*a* of the coaxial cable 3, said cable being shielded using a metal braid 4 surrounding at least one axial electric conductor 2 (in broken lines); the metal braid 4 may in particular be made from copper, aluminum or steel;
- a metal conductor 10 that can be connected to a system that is electrically powered and that itself is electromagnetically protected; this electrical connector includes an end channel 12 in which said end 3*a* of the shielded cable 3 engages;
- the conducting overmolding 5 that overmolds the end 3*a* of the cable and part of the channel of the connector 10; this overmolding is advantageously done from a conducting material described below, so as to ensure 360° grounding guaranteeing the equipotentiality of the metal braid 4 and the connector 10; as shown in FIGS. 1A to 1D, the overmolded part 5 has a substantially cylindrical shape.

After having inserted the end 3*a* of the cable 3 in the free space of the channel 12, the metal braid 4 can:

abut against the end walls of the channel 12 of the connector 10, as shown in FIG. 1B;

cover the walls of the channel 12 of the connector 10, as shown in FIG. 1C;

be inserted into the space delimited by the walls of the channel 12 of the connector 10, as shown in FIG. 1D.

The overmolded part 5 covers the end 3*a* of the cable 3 and therefore the metal braid 4, as well as at least part of the channel 12 of the connector 10, which advantageously makes it possible to ensure 360° grounding.

The overmolding 5 may be done:

either from an injectable polymer material or a thermoplastic material such as Santoprene™, filled with conductive particles, or an organic intrinsically conducting polymer (ICP) material, the goal being to achieve a resistivity of approximately 5 mΩ/cm.

Advantageously, the overmolding may include a binder comprising a silicone elastomer material or an elastomeric plastic, which is preferably injectable.

Advantageously, the overmolding may include a filler of conductive particles comprised between x and y %, preferably approximately 80% so as to achieve the aforementioned low resistivity.

In the case of a non-conductive polymer binder, the conductive particles may be:

Silver particles,

Graphite-covered Nickel particles,

Silver-covered Copper particles, or

Silver-covered Aluminum particles.

The use of a noble metal such as Silver makes it possible to avoid oxidation. These particles have a diameter comprised between 20 and 40 μm.

The invention claimed is:

1. A device for producing a junction between an end (3*a*) of a shielded coaxial cable (3) received in an end channel (12) located at an end portion of a metal connector (10), said cable including a peripheral metal braid (4) and an axial conductor (2), said end channel (12) including an exterior peripheral wall at said end portion, the device comprising:

a conducting overmolding (5) at least partially surrounding the end (3*a*) of the shielded coaxial cable (3) and partially surrounding the end channel (12) with an interior surface of an endmost portion of the conducting overmolding directly contacting the exterior peripheral wall of the end channel at the end portion of said metal connector (10), said conducting overmolding extending over said metal connector at least to a distal end face of the shielded coaxial cable transverse to an axis of the shielded coaxial cable so that a contact area between the end of the shielded coaxial cable (3) and the metal connector (10) is covered with said conducting overmolding, said conducting overmolding being in electrical contact with said metal braid (4) and the end channel of said metal connector (10), so as to ensure continuity of electromagnetic shielding of the junction, wherein an endmost portion of said metal braid (4) comprises a first side and an opposite second side, and wherein said end (3*a*) of the shielded coaxial cable (3) is received in the end channel (12) located at the end portion of said metal connector (10) at least partially surrounding by the conducting overmolding, and the first side of the endmost portion of said metal braid (4) at least partially covering and directly contacting a part of the exterior peripheral wall of said end channel (12) adjacent the endmost portion of the conducting overmolding that directly contacts the exterior peripheral wall at the end portion of the metal connector (10), and the opposite second side of the endmost portion of the metal braid (4) directly contacting the interior surface of a portion of the conducting overmolding immediately adjacent the endmost portion of the conducting overmolding that direct contacts the exterior peripheral wall at the end portion of said metal connector (10).

2. The device according to claim 1, wherein said conducting overmolding (5) includes an intrinsically conductive polymer material.

3. The device according to claim 2, wherein said conducting overmolding includes a binder comprising a silicone elastomer material or an elastomeric plastic.

4. The device according to claim 2, wherein said conducting overmolding includes a filler of approximately 80% conductive particles.

5. The device according to claim 1, wherein said conducting overmolding (5) includes a nonconductive polymer material charged with conductive particles.

6. The device according to claim 5, wherein said conductive particles comprise at least one of an intrinsically inoxidizable or relatively inoxidizable metal, and a metal coated with a conducting layer protecting against oxidation.

7. The device according to claim 6, wherein said conductive particles are chosen from the list consisting of: Silver particles, Graphite-covered Nickel particles, Silver-covered Copper particles, and Silver-covered Aluminum particles.

8. The device according to claim 6, wherein said conductive particles have a diameter between 20 and 40 μm.

9. The device according to claim 5, wherein said conductive particles are chosen from the list consisting of: Silver particles, Graphite-covered Nickel particles, Silver-covered Copper particles, and Silver-covered Aluminum particles.

10. The device according to claim 9, wherein said conductive particles have a diameter between 20 and 40 μm.

11. The device according to claim 5, wherein said conductive particles have a diameter between 20 and 40 μm.

12. The device accordingly to claim 1, wherein said conducting overmolding extends over said connector beyond the distal end face of the shielded coaxial cable.

13. A method for connecting a shielded coaxial cable (3) and a metal connector (10) while ensuring continuity of electromagnetic shielding of the assembly, the method comprising:

stripping one end (3*a*) of the shielded coaxial cable (3) so as to expose an axial conductor (2) and a metal shielding braid (4), an endmost portion of the metal shielding braid (4) comprising a first side and an opposite second side;

partially receiving said one end (3*a*) of the shielded coaxial cable (3) in an end channel (12) of the metal connector (10) so as to leave a portion of the metal shielding braid (4) visible and to put the metal shielding braid (4) and walls of the channel (12) in electrical contact, wherein the first side of the endmost portion of the metal shielding braid (4) at least partially covers and directly contacts an exterior peripheral wall of said end channel (12); and using a conducting material (5) to form a conducting overmolding (5) overmolding a visible exterior part of the metal shielding braid (4) of said one end (3*a*) of the shielded coaxial cable (3) and at least part of said end channel (12) of the metal connector (10), the conducting material being in electrical contact with the metal connector, the conducting material extending at least to a distal end face of the shielded coaxial cable transverse to an axis of the shielded coaxial cable so that a contact area between the one end of the shielded coaxial cable (3) and the connector (10) is covered with said conducting overmolding (5) at least partially surrounding the one end (3*a*) of the shielded coaxial cable (3) with an interior surface of the endmost portion of the conducting overmolding directly contacting the exterior peripheral wall of said end channel at the end portion of the metal connector (10) and the first side of the endmost portion of said metal braid (4) at least partially covering and directly contacting a part of the exterior peripheral wall of said end channel (12) adjacent the endmost portion of the conducting overmolding that directly contacts the exterior peripheral wall of said end channel at the end portion of the metal connector (10), and the opposite second side of the endmost portion of the metal braid (4) directly contacting the interior surface of a portion of the conducting overmolding immediately adjacent the endmost portion of the conducting overmolding that direct contacts the exterior peripheral wall of said end channel at the end portion of said metal connector (10).

14. The method accordingly to claim 13, wherein said overmolding conducting material extends beyond the distal end face of the cable.

* * * * *